US008643464B2

(12) United States Patent
Nazzaro

(10) Patent No.: US 8,643,464 B2
(45) Date of Patent: Feb. 4, 2014

(54) LIQUID-COOLED RESISTOR DEVICE

(71) Applicant: Cressal Resistors Limited, Leicester (GB)

(72) Inventor: Giuseppe Nazzaro, Leicester (GB)

(73) Assignee: Cressall Resistors Limited (GB)

( * ) Notice: Subject to any disclaimer, the term of this patent is extended or adjusted under 35 U.S.C. 154(b) by 0 days.

(21) Appl. No.: 13/674,179

(22) Filed: Nov. 12, 2012

(65) Prior Publication Data

US 2013/0120103 A1 May 16, 2013

(30) Foreign Application Priority Data

Nov. 14, 2011 (EP) ..... 11009025

(51) Int. Cl.
*H01C 1/082* (2006.01)

(52) U.S. Cl.
USPC ..... 338/55; 338/56

(58) Field of Classification Search
USPC ..... 338/53, 55, 58
See application file for complete search history.

(56) References Cited

U.S. PATENT DOCUMENTS

| | | | | |
|---|---|---|---|---|
| 4,420,739 | A * | 12/1983 | Herren | 338/53 |
| 4,434,417 | A * | 2/1984 | Beriger et al. | 338/53 |
| 5,353,005 | A * | 10/1994 | Salanki | 338/55 |
| 7,200,007 | B2 * | 4/2007 | Yasui et al. | 361/716 |
| 7,360,582 | B2 * | 4/2008 | Olesen | 165/80.4 |

FOREIGN PATENT DOCUMENTS

| | | |
|---|---|---|
| DE | 3204683 | 8/1983 |
| DE | 3933956 | 4/1991 |
| EP | 0454904 | 11/1991 |
| JP | 2000252101 | 9/2000 |
| WO | WO2005/041627 | 5/2005 |

OTHER PUBLICATIONS

European Search Report; EP Application No. EP11009025.5; European Filing Date: Nov. 14, 2011; 4 pages.
English Abstract of Japanese Patent No. 2000252101; Publication Date: Sep. 14, 2000; 1 page.
English Abstract of European Patent No. EP0454904; Publication Date: EP0454904; 1 page, Nov. 6, 1991.
English Abstract of German Patent No. DE3933956; Publication Date: Apr. 25, 1991; 1 page.
English Abstract of German Patent No. DE3204683; Publication Date: Aug. 18, 1983; 1 page.

* cited by examiner

*Primary Examiner* — Kyung Lee
(74) *Attorney, Agent, or Firm* — Blank Rome LLP

(57) ABSTRACT

A liquid-cooled resistor device including a block having a liquid inlet, a liquid outlet, and a cavity. The cavity is provided with a liquid flow path between the liquid inlet and the liquid outlet. The cavity can have an open side which is closed by a thermally conductive, electrically insulating flat layer. The flat layer can further support a flat resistor, the main plane of each being in parallel. The device can further include an electrically insulating blocking plate, fastenable to the block. The blocking plate can face the resistor to block the resistor on the flat layer. The device can also include a elastic pressing device positioned and configured to force the flat layer against the resistor.

19 Claims, 1 Drawing Sheet

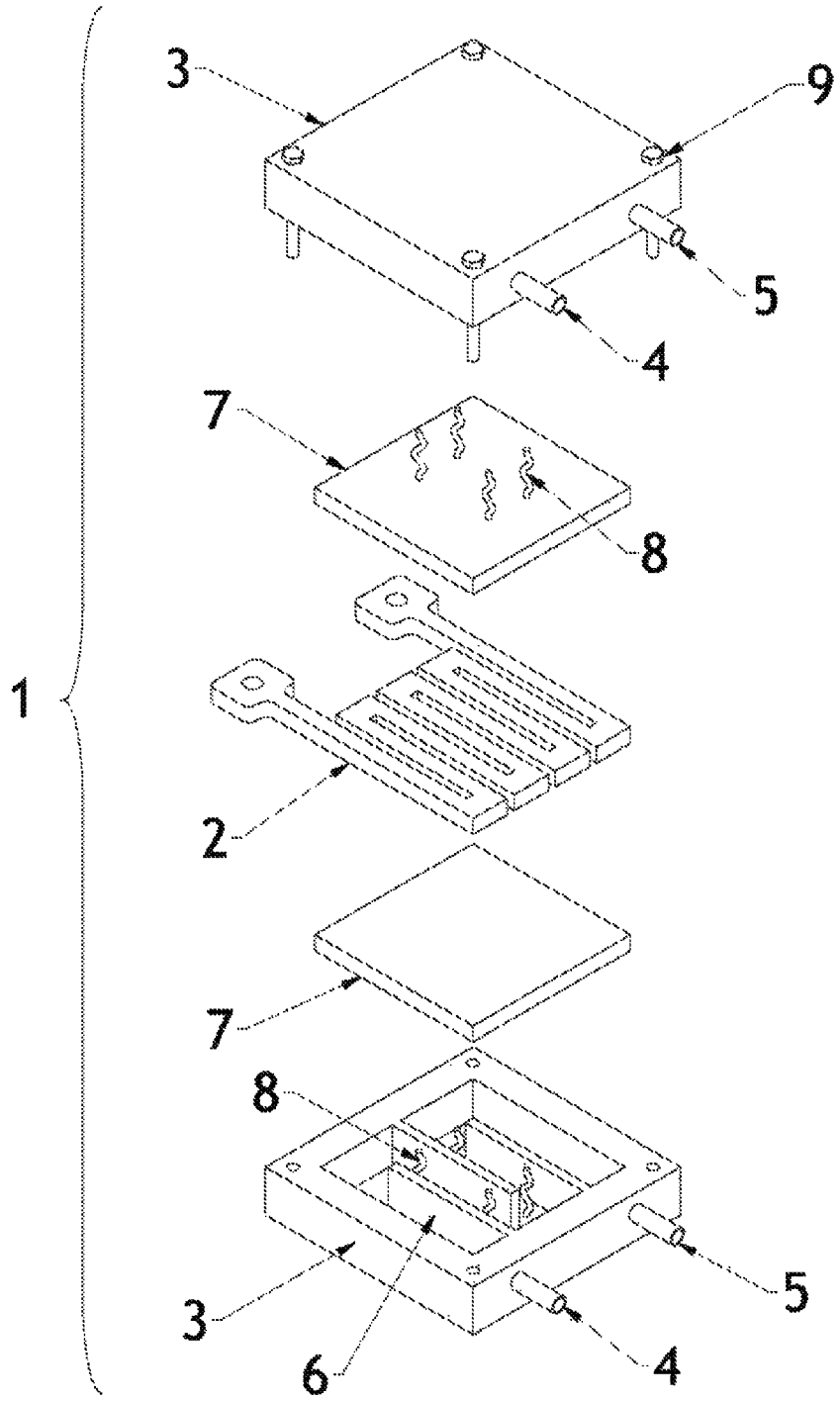
3
9
5
4
7
8
1
2
7
8
5
3
6
4

LIQUID-COOLED RESISTOR DEVICE

RELATED APPLICATIONS

This application claims benefit of priority of European Patent Application No. 11009025.5, filed Nov. 14, 2011, in the name of Cressal Resistors Ltd.; which application is incorporated herein by reference.

FIELD OF THE INVENTION

The present invention relates to resistor devices; and more particularly to liquid-cooled resistor devices.

BACKGROUND OF THE INVENTION

Liquid-cooled resistor devices known from the prior art can be employed in a wide variety of applications, including regenerative braking of devices using an inverter-driven electric motor which can also function as a generator.

DE 3933956 discloses a liquid-cooled resistor device for use in electric vehicles, with a flat resistor mounted between two liquid-cooled, electrically insulated blocks. The resistor is kept in place simply by rigid connection between the two blocks. GB2478547 discloses a liquid-cooled brake resistor device for use in electric vehicles, with a flat resistor is disposed between a liquid-cooled, electrically insulated block and a blocking plate or a further liquid-cooled block. The resistor is kept in place by rigid connection between the block and the blocking plate, or between the two blocks, as well as by expansion guide means at last partially surrounding the resistor to confine expansion in its main plane.

One of the drawbacks of the devices of the prior art is that the thermal contact resistance at the resistor-block or resistor-insulation layer interface limits the efficiency and efficacy of the heat transfer. Moreover, the low heat capacity of the block relative to the cooling liquid limits the overall rate of heat dissipation from the resistor.

Further, for use of the devices for braking inverter-driven electric motors, relatively large resistors and liquid-cooled blocks are required in order to manage the high energy dissipation requirements involved, which can in practice render the devices bulky and heavy.

SUMMARY OF THE INVENTION

A technical task proposed by the present invention is therefore that of providing a liquid-cooled resistor device that overcomes the noted technical drawbacks of the prior art.

Within the scope of this technical task, an advantage of the present invention is that of providing a liquid-cooled resistor device having improved efficiency and efficacy of heat dissipation from the resistor.

Another advantage is that of providing a liquid-cooled resistor device that is compact and lightweight.

A last but not least advantage of the invention is that of providing a liquid-cooled resistor device that is safe and economical.

These and other technical tasks, as well as these and other advantages, are achieved according to various embodiments of liquid-cooled resistor device according to present invention.

In one embodiment, a liquid-cooled resistor device includes a block that includes a liquid inlet, a liquid outlet and a cavity. The cavity can have a liquid flow path between the liquid inlet and the liquid outlet, and can further have an open side. A thermally conductive, electrically insulating flat layer is also included. The flat layer can be configured along a plane, with the flat layer covering the open side of the cavity. Also included is a resistor, also configured in a plane, where the plane of the resistor can be positioned parallel to the plane of the flat layer. An electrically insulating blocking plate, fastenable to the block, can be included, and can face the resistor to hold the resistor against the flat layer. Lastly, an elastic pressing device can exist between the block and the flat layer, the elastic pressing device forcing the flat layer against the resistor.

The use of a elastic pressing device to force the thermally conductive, electrically insulating flat layer against the resistor ensures improved heat transfer between the resistor and the flat layer. Moreover, the closure of the cavity of the block by the flat layer and the placement of the elastic pressing device in the cavity improves the heat transfer from the layer to the liquid. The overall heat transfer efficiency and efficacy improvement allows the device of the invention to be smaller and lighter than those of the noted prior art.

Furthermore, the use of elastic pressing device increases the stiffness of the device in a direction perpendicular to the plane of the resistor, thereby bringing it substantially above the characteristic vibration frequencies of vehicles and rolling stock. Hence, the device is better able to withstand vibration and shock during use.

In one aspect of the invention, the liquid flow path can be defined by partitioning walls within the cavity. The partitioning walls can have a height, relative to that of the cavity, so that the partitioning walls are spaced apart from the flat layer to allow a small bypass of liquid to flow over a top of the partitioning walls, between the top of the partitioning walls and the flat layer, during liquid flow in the liquid flow path (where liquid flows between the liquid inlet and the liquid outlet) to prevent dry areas of the flat layer.

In another embodiment of the invention, a liquid-cooled resistor device includes two blocks, fastenable to one another, each block including a liquid inlet, a liquid outlet and a cavity, where each cavity has a liquid flow path between the liquid inlet and the liquid outlet, with each cavity further having an open side. Two thermally conductive, electrically insulating flat layers are also included. Each flat layer can be configured along a plane, where each flat layer covers a respective open side of a cavity. A resistor can be positioned in a middle thereof, configured in a plane, with the plane of the resistor positioned parallel to respective planes of the two flat layers. Lastly, two elastic pressing devices can also be included, with each positioned between a respective block and flat layer, where each elastic pressing device forces its respective flat layer against the resistor.

BRIEF DESCRIPTION OF THE DRAWINGS

Other characteristics of the present invention are moreover defined in the subsequent claims. Further characteristics and advantages of the present invention will be more evident from the description of a preferred, but not exclusive, embodiment of the liquid-cooled resistor device according to the finding, illustrated in the attached non-limiting drawing, wherein:

FIG. 1 shows an exploded view of one embodiment of a liquid-cooled resistor device of the present invention.

DETAILED DESCRIPTION OF THE VARIOUS EMBODIMENTS

With reference to FIG. 1, the liquid-cooled resistor device (generally indicated by 1), comprises a resistor (2), preferably in the form of a flat grid of electrically resistive material. The electrical connection of said resistor (2) to a power circuit is preferably by terminals which are part of or connected to the resistor (2).

The resistor (2) rests on a thermally conductive, electrically insulating flat layer (7), disposed such that their main planes are parallel to one another. The flat layer (7) is preferably made of aluminium nitride ceramic and comprises a rigid sheet.

At least one block (3) is provided, preferably made of an electrically and thermally insulating material, in particular preferably moulded thermoset plastic. It is provided with a liquid inlet (4) and a liquid outlet (5), preferably disposed parallelly and as a function of the width of said block. The block further has a cavity provided with a liquid flow path (6) between the inlet (4) and the outlet (5). Advantageously, the cavity can be machined in the face of the block (6) that is oriented towards the resistor (2), such that the cavity has an open side that can be closed by the thermally conductive, electrically insulating flat layer (7).

Preferably, the cavity has a peripheral shoulder on which said flat layer (7) rests. In this way the liquid flow path (6) is closed and the liquid cannot contact the resistor (2).

Preferably, the flow path (6) covers the same footprint as the maximum area of the resistor (2) in order to maximise energy dissipation. Advantageously, the liquid used for cooling can be water and it is preferably introduced into the flow path (6) at a flow rate sufficiently high to sustain turbulent flow throughout the flow path.

Preferably, the peaks of the partitioning walls defining the liquid flow path (6) within the cavity are spaced apart from the layer (7) such that a small bypass of liquid over said peaks is possible. This prevents dry regions on the flat layer (7) in the footprint of the resistor (2), in turn avoiding hot spots that could impair heat transfer and the integrity of the device.

An electrically insulated blocking plate is provided, rigidly fastenable to the block (3), with the resistor (2) being blocked between the blocking plate and the flat layer (7). Preferably, the blocking plate comprises a further block (3) with a further thermally conductive, electrically insulating layer (7) disposed between the further block (3) and the resistor (2), as shown in FIG. 1. Preferably, the two blocks (3) are rigidly fastenable to one another via fastening rivets (9).

An elastic pressing device is disposed between the block (3) and the thermally conductive, electrically insulating flat layer (7), subjecting said flat layer (7) to a force against resistor (2). In particular, the elastic pressing device is housed in the cavity of the block (3). Preferably, the elastic pressing device is configured to force the flat layer (7) against the resistor (2) with an almost uniform contact pressure at the contact area between the flat layer (7) and the resistor (2). In one embodiment, the elastic pressing device comprises a plurality of springs (8) disposed in the internal liquid flow path (6) of the block (3). Preferably, each of the springs (8) is disposed with its axis perpendicular to said internal liquid flow path (6). Preferably the springs (8) are made of stainless steel.

In the arrangement wherein a block (3) is present on each side of the resistor (2) as shown in FIG. 1, the springs (8) are configured so as to provide a force distributed across a face of each of the flat layers (7), providing tight contact between the resistor (2) and each of the flat layers (7). In addition to improving the heat transfer between the resistor (2) and the thermally conductive, electrically insulating flat layer (7), the presence of the springs in the internal liquid flow path (6) of the block (3) increases the turbulence of the liquid flow, which in turn improves the heat transfer from the thermally conductive, electrically insulating flat layer (7) to the liquid. The springs also decrease the cross-section of the internal liquid flow path (6), thereby increasing the speed of the liquid flow and hence the heat transfer rate from the flat layer (7) to the liquid without increasing the required volumetric flow rate of liquid.

Overall, the presence of the elastic pressing device provides a 200-300% increase in heat transfer from the resistor (2), in turn enabling the device to be made smaller and lighter than those of the prior art. The use of thermoset plastic for the block (3) further aids the compact and lightweight construction of the device.

Optionally, the device comprises expansion guide means (not shown) disposed between fins of the resistor (2) to confine the expansion of the resistor in its main plane in order to prevent mutual contact between the fins of the resistor and subsequent short-circuiting. Preferably, the expansion guide means comprise at least one mica paper strip. The thickness of this at least one strip is advantageously no more than that of the resistor (2) so as to not impede the contact between the resistor (3) and the insulating layer (7).

The liquid-cooled resistor device thus conceived is susceptible to numerous modifications and variations, all falling within the scope of the inventive concept; furthermore, all details may be substituted by technically equivalent elements.

In practice, any material type or size may be used, according to the needs and the state of the art.

These and other advantages of the present invention will be apparent to those skilled in the art from the foregoing specification. Accordingly, it will be recognized by those skilled in the art that changes or modifications may be made to the above described embodiments without departing from the broad inventive concepts of the invention. Any specific dimensions provided for any particular embodiment of the present invention are for illustration purposes only. It should therefore be understood that this invention is not limited to the particular embodiments described herein, but is intended to include all changes and modifications that are within the scope and spirit of the invention and claims, and of the problems solved by illustrated embodiments.

The invention claimed is:

1. A liquid-cooled resistor device, comprising:

a block including a liquid inlet, a liquid outlet and a cavity, the cavity having a liquid flow path between the liquid inlet and the liquid outlet, the cavity further having an open side;

a thermally conductive, electrically insulating flat layer, the flat layer configured along a plane, the flat layer covering the open side of the cavity;

a resistor configured in a plane, the plane of the resistor positioned parallel to the plane of the flat layer;

an electrically insulating blocking plate, fastenable to the block, the blocking plate facing the resistor and holding the resistor against the flat layer; and an elastic pressing device between the block and the flat layer, wherein the elastic pressing device forces the flat layer against the resistor.

2. The liquid-cooled resistor device of claim 1, wherein the elastic pressing device is configured to force the flat layer against the resistor with an almost uniform contact pressure at a contact area therebetween.

3. The liquid-cooled resistor device of claim 1, wherein the elastic pressing device comprises a plurality of springs disposed within the liquid flow path of the cavity of the block.

4. The liquid-cooled resistor device of claim 3, wherein each of the springs is disposed with an axis perpendicular to that of the liquid flow path.

5. The liquid-cooled resistor device of claim 3, wherein each of the springs are made of stainless steel.

6. The liquid-cooled resistor device of claim 1, wherein the electrically insulating blocking plate comprising:

a further block;

a further thermally conductive, electrically insulating flat layer disposed between the further block and the resistor; and a further elastic pressing device between the further block and the further flat layer, wherein the further elastic pressing device forces the further flat layer against the resistor.

7. The liquid-cooled resistor device of claim 6, wherein the further block includes a liquid inlet, a liquid outlet and a cavity, the cavity having a liquid flow path between the liquid inlet and the liquid outlet, the cavity further having an open side covered by the further flat layer, and the further elastic pressing device is disposed within the liquid flow path of the cavity of the further block.

8. The liquid-cooled resistor device of claim 7, wherein the further elastic pressing device comprises a plurality of springs disposed within the liquid flow path of the cavity of the further block, the plurality of springs configured to force the further flat layer against the resistor with an almost uniform contact pressure at a contact area therebetween.

9. The liquid-cooled resistor device of claim 8, wherein each of the springs is disposed with an axis perpendicular to that of the liquid flow path of the cavity of the further block.

10. The liquid-cooled resistor device of claim 1, wherein the liquid flow path is defined by partitioning walls within the cavity, the partitioning walls having a height, relative to that of the cavity, so that the partitioning walls are spaced apart from the flat layer, thereby allowing a small bypass of liquid over a top of the partitioning walls, between the top of the partitioning walls and the flat layer, during liquid flow in the liquid flow path, thereby preventing dry areas of the flat layer.

11. The liquid-cooled resistor device of claim 1, wherein the block IS made of an electrically and thermally insulating material.

12. The liquid-cooled resistor device of claim 1, wherein the block is made of thermoset plastic.

13. The liquid-cooled resistor device of claim 1, wherein the flat layer IS made of aluminium nitride ceramic.

14. The liquid-cooled resistor device of claim 1, further comprising an expansion guide means disposed between fins of the resistor, thereby confining expansion of the resistor in its main plane to prevent mutual contact between the fins.

15. The liquid-cooled resistor device of claim 14, wherein the expansion guide means comprise at least one mica paper strip.

16. A liquid-cooled resistor device, comprising:

two blocks, fastenable to one another, each block including a liquid inlet, a liquid outlet and a cavity, where each cavity has a liquid flow path between the liquid inlet and the liquid outlet, with each cavity further having an open side;

two thermally conductive, electrically insulating flat layers, each flat layer configured along a plane, where each flat layer covers a respective open side of a cavity;

a resistor configured in a plane, the plane of the resistor positioned parallel to respective planes of the two flat layers; and two elastic pressing devices, each positioned between a respective block and flat layer, wherein each elastic pressing device forces its respective flat layer against the resistor.

17. The liquid-cooled resistor device of claim 16, wherein each elastic pressing device comprises a plurality of springs disposed within respective liquid flow paths of the cavities of the two blocks, the plurality of springs configured to force respective flat layers against the resistor with an almost uniform contact pressure at respective contact areas therebetween.

18. The liquid-cooled resistor device of claim 17, wherein each of the plurality of springs is disposed with an axis perpendicular to that of the respective liquid flow path of the cavity of the respective block.

19. The liquid-cooled resistor device of claim 16, wherein respective liquid flow paths are each defined by partitioning walls within respective cavities, the partitioning walls having a height, relative to that of the respective cavity, so to be spaced apart from the respective flat layer, thereby allowing a small bypass of liquid over a top of the partitioning walls, between the top of the partitioning walls and the respective flat layer, during liquid flow in the liquid flow path, between the respective liquid inlet and the liquid outlet, thereby preventing dry areas of each flat layer.

* * * * *

UNITED STATES PATENT AND TRADEMARK OFFICE

CERTIFICATE OF CORRECTION

PATENT NO. : 8,643,464 B2
APPLICATION NO. : 13/674179
DATED : February 4, 2014
INVENTOR(S) : Giuseppe Nazzaro It is certified that error appears in the above-identified patent and that said Letters Patent is hereby corrected as shown below:

On the Title Page, Item (71), Applicant,
Delete "Cressal Resistors Limited" and insert --Cressall Resistors Limited--

Signed and Sealed this
Seventeenth Day of March, 2015

Michelle K. Lee

Michelle K. Lee
*Director of the United States Patent and Trademark Office*